US012624687B2

(12) United States Patent
Boivin et al.

(10) Patent No.: US 12,624,687 B2
(45) Date of Patent: May 12, 2026

(54) PUMP MANIFOLD WITH REDUNDANCY FOR GAS EXTRACTION SYSTEM

(71) Applicant: ABB Schweiz AG, Baden (CH)

(72) Inventors: Alexandre Boivin, Québec (CA); Marc Burnett, Québec (CA); Dominic Michaud, Lac-Beauport (CA); Kyle Owen, Lompoc, CA (US); Axel Meunier, Quebec (CA); John Brian Leen, Sunnyvale, CA (US)

(73) Assignee: ABB Schweiz AG, Baden (CH)

( * ) Notice: Subject to any disclaimer, the term of this patent is extended or adjusted under 35 U.S.C. 154(b) by 66 days.

(21) Appl. No.: 17/849,400

(22) Filed: Jun. 24, 2022

(65) Prior Publication Data

US 2023/0418314 A1 Dec. 28, 2023

(51) Int. Cl.
*F04B 23/04* (2006.01)
*F04B 51/00* (2006.01)

(52) U.S. Cl.
CPC ..... *F04B 23/04* (2013.01); *F04B 51/00* (2013.01)

(58) Field of Classification Search
CPC ..... F04B 23/04; F04B 41/06; F04B 49/065; F04B 49/02; F04B 51/00; F04B 39/0038; F04D 25/16; Y10T 137/86163; Y10T 137/97885
USPC ..... 417/542, 62, 248, 263, 529, 533, 539, 417/3–8
See application file for complete search history.

(56) References Cited

U.S. PATENT DOCUMENTS 3,744,932 A * 7/1973 Prevett ..... G05D 9/12 417/7
4,897,022 A * 1/1990 Hudson ..... F04D 15/029 417/540
4,988,269 A * 1/1991 Blass ..... F04B 39/0055 181/403
6,647,769 B1 * 11/2003 Fujino ..... F02B 77/08 73/114.43
8,371,821 B1 * 2/2013 Mehr ..... F04D 15/0218 417/40

(Continued)

FOREIGN PATENT DOCUMENTS

CN 114251255 A 3/2022
DE 102013007887 A1 12/2013

OTHER PUBLICATIONS

Partial European Search Report for Patent Application No. EP23179301.9, dated Sep. 22, 2023, 12 pps.

(Continued)

*Primary Examiner* — Essama Omgba
*Assistant Examiner* — Dnyanesh G Kasture
(74) *Attorney, Agent, or Firm* — McCarter & English, LLP; Michael M. Gnibus

(57) ABSTRACT

The present disclosure relates to systems and methods that include a multiple pump manifold to provide redundancy for use with high availability gas extraction system in industrial instrumentation. A method of operating a redundant pump assembly including operating a first pump of a plurality of pumps for an operation period; validating a second pump of the plurality of pumps at the end of the operation period of the first pump; validating a third pump of the plurality of pumps at the end of the operation period of the first pump; and, operating the third pump for the operation period, where the second pump and third pump are validated as operational.

20 Claims, 9 Drawing Sheets

(56) References Cited

U.S. PATENT DOCUMENTS

| | | | | |
|---|---|---|---|---|
| 2001/0014840 | A1* | 8/2001 | Marshall | G05D 11/132 700/266 |
| 2007/0128047 | A1 | 6/2007 | Gonnella | |
| 2013/0327297 | A1* | 12/2013 | Sgatti | F02M 69/50 123/456 |
| 2014/0228762 | A1* | 8/2014 | Capone | A61M 5/16881 604/152 |
| 2015/0216760 | A1* | 8/2015 | Adams | A61H 9/0078 601/152 |
| 2015/0343106 | A1* | 12/2015 | Zaro | F04B 23/04 137/15.04 |
| 2017/0254333 | A1 | 9/2017 | Shuy | |
| 2017/0300027 | A1 | 10/2017 | Oyama | |
| 2018/0003122 | A1 | 1/2018 | Burkell | |
| 2018/0095031 | A1 | 4/2018 | Owen et al. | |
| 2018/0110906 | A1* | 4/2018 | Barack | A61M 1/06935 |
| 2020/0003217 | A1 | 1/2020 | Wilds | |
| 2020/0240418 | A1 | 7/2020 | Correia | |
| 2020/0360738 | A1* | 11/2020 | Berge | A45C 13/021 |
| 2022/0025894 | A1* | 1/2022 | Mayleben | H02H 7/08 |

OTHER PUBLICATIONS

European Search Report for EP Patent Application No. 23179301.9 dated Feb. 14, 2024; 6 pp.
European Office Action for Application No. 23179301.9, Nov. 28, 2025, 6 pages.
Australian Office Action for Application No. 2024259890, dated Jan. 23, 2026, 2 pages.

* cited by examiner

PUMP MANIFOLD WITH REDUNDANCY FOR GAS EXTRACTION SYSTEM

BACKGROUND

The field of the disclosure relates generally to systems of a multiple pump manifold with to provide redundancy in gas extraction systems, and more particularly, to systems and methods that include a multiple pump manifold to provide redundancy for use with high availability gas extraction system in industrial instrumentation.

Whenever fuel gas such as natural gas, coal syngas, or biogas, is generated, transferred, or used, an assessment and understanding of the levels of contaminants is typically required in order to effectively transfer or use the desired fuel gas in an associated process. The measurement of various contaminants, e.g., $H_2S$, $H_2O$, $O_2$, and $CO_2$, is an important process step that aids in the prevention of infrastructure damage due to corrosion or chemical reactivity that in-part is a product of fuel gas contaminants. Natural gas producers must clean extracted gas to remove contaminants and then verify residual contaminant levels before introducing natural gas into a pipeline. Desulfurizer bed, used as fuel reformers to remove a variety of fuel gas contaminants must be periodically replaced or regenerated to prevent $H_2S$ breakthrough into the reformed fuel product, reinforcing the need for frequent contaminant level monitoring in fuel gas.

The systems and instruments for measurement of contaminants are often stored in inaccessible and harsh environments. Such systems require continuous control of the flow and pressure of the component that is to be measured. Pumps are used to deliver the controlled flow at a stable under-pressure. However, pumps and pumping systems have a limited lifetime, limiting the reliability of the measurement system. Because the volume of gas in the extraction system can be significant, when a pump fails, the measurement response times, and accuracy will be negatively impacted which will yield the consumption (and exhaust to atmosphere) of relatively large volumes of fuel gas. Continuous operation of the system is essential in preventing catastrophic failure of the instrumentation and of the pipeline.

Therefore, there exists a need in the art to provide for a pump manifold with redundancies for gas extraction systems and instrumentation.

BRIEF DESCRIPTION

In one aspect, a method of operating a redundant pump assembly is disclosed. The method includes operating a first pump of a plurality of pumps for an operation period; validating a second pump of the plurality of pumps at the end of the operation period of the first pump; validating a third pump of the plurality of pumps at the end of the operation period of the first pump; and, operating the third pump for the operation period, where the second pump and third pump are validated as operational.

In another aspect, redundant pump manifold assembly for use with a measurement instrument is disclosed. The assembly includes a first plate having a first surface and a second surface defining a thickness of the first plate, the second surface including a plurality of channels extending into the second surface, and a first aperture and second aperture extending from the plurality of channels to the first surface; and, a second plate having a first surface and a second surface defining a thickness of the first plate, the first surface of the second plate abutting the second surface of the first plate, wherein the first surface of the second plate includes a recessed surface for receiving a gasket positioned between the first plate and second plate creating a fluid seal between the first plate and second plate. The corresponding protrusions extend from the recessed surface of the second plate, the corresponding protrusions configured to align with the plurality of channels.

DRAWINGS

These and other features, aspects, and advantages of the present disclosure will become better understood when the following detailed description is read with reference to the accompanying drawings in which like characters represent like parts throughout the drawings.

DETAILED DESCRIPTION

In the following specification and the claims, reference will be made to a number of terms, which shall be defined to have the following meanings.

As used herein, the singular forms "a," "an," and "the" include plural references unless the context clearly dictates otherwise. The terms "comprising," "including," and "having" are intended to be inclusive and mean that there may be additional elements other than the listed elements. The terms "optional" or "optionally" means that the subsequently described event or circumstance may or may not occur, and that the description includes instances where the event occurs and instances where it does not.

Measurement of various contaminants, e.g. Hydrogen Sulfide ($H_2S$), Water ($H_2O$), Oxygen ($O_2$), and Carbon Dioxide ($CO_2$), in fuel gas is needed for preventing infrastructure damage and for compliance with operation requirements. Corrosion from $H_2S$, $CO_2$, $H_2O$ and $O_2$ negatively impacts the integrity of associated delivery infrastructure and the degradation of the infrastructure may result in cracks or other openings that enable the fuel gas to leak undesirably to downstream assets. $H_2S$ is deadly even at low parts per million (ppm) values. Excess $H_2O$ leads to hydrates that decrease flow capacity and potential blockage. Excess $O_2$ degrades gas processing chemicals such as amines. In addition, $H_2S$, $CO_2$, $H_2O$ and $O_2$ do not comprise fuel gas components that enhance the inherent combustibility of the fuel gas, and therefore may be removed from fuel gases.

Gas extraction systems are configured to control pressure and flow to a fuel gas analysis cell. The analysis cells are designed to operate with a high degree of availability and uninterrupted measurement performance. Interruptions in analysis cell performance/analysis cell down time can occur for example due to pump failure, leakage of the measurement assembly or pump assembly and leakage between tubing, fittings, and components of the measurement system generally. Embodiments of the present disclosure are directed to a pump manifold having built in redundancy and periodic validation of pump health and performance incorporated into a modular primary manifold which minimizes tubing and tube fittings to minimize leaks, minimizes the envelope of the system and has fast response time and for easy replacement. The embodiments of the present disclosure will maximize operation of the analysis cells by minimizing analysis cell down time due to pump failure.

Figure 1:
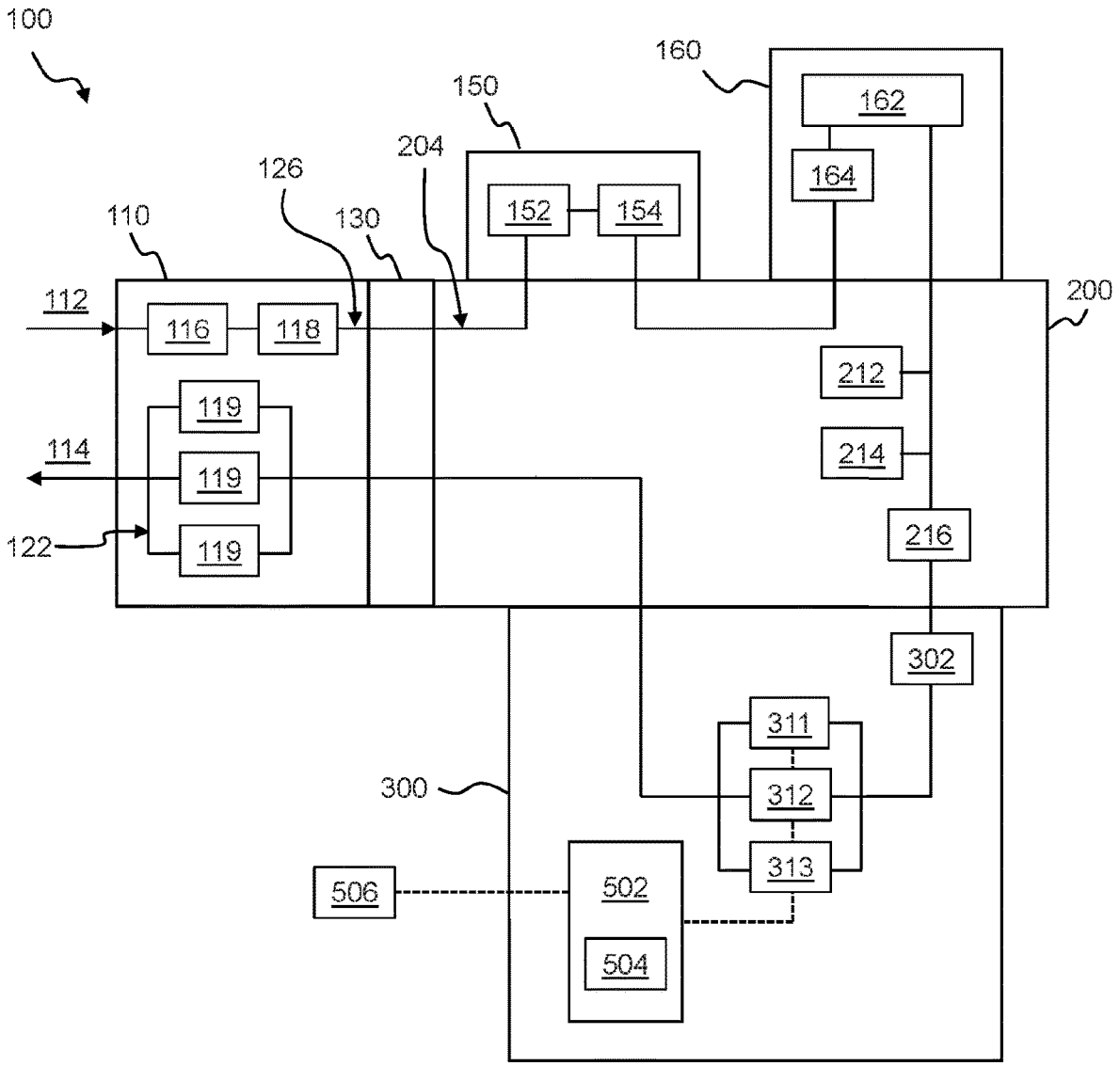
FIG. 1 is a schematic diagram of an exemplary measurement assembly in accordance with one or more embodiments of the present disclosure.
Figure 2:
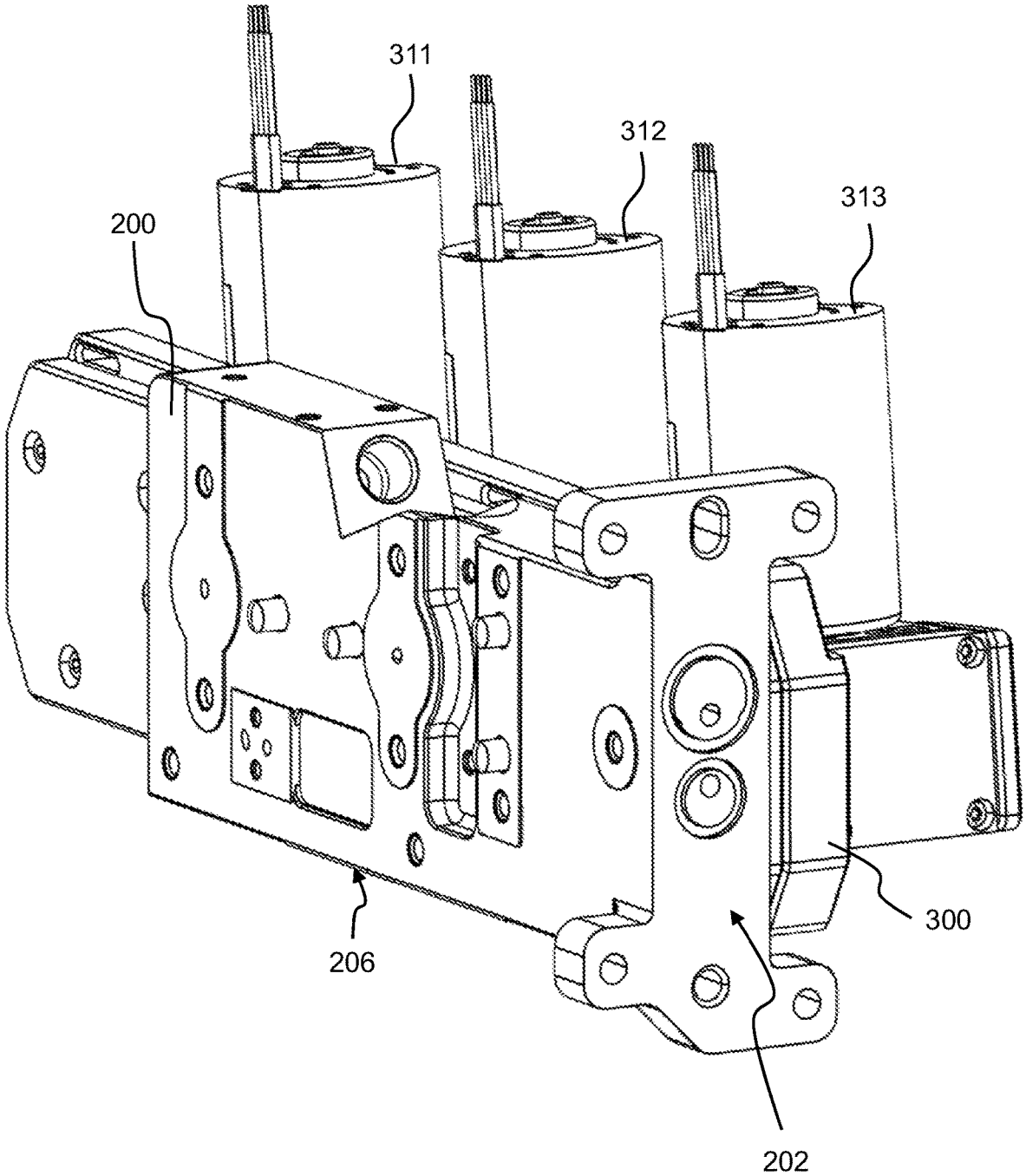
FIG. 2 illustrates a perspective view of the main measurement assembly of FIG. 1.
Figure 3:
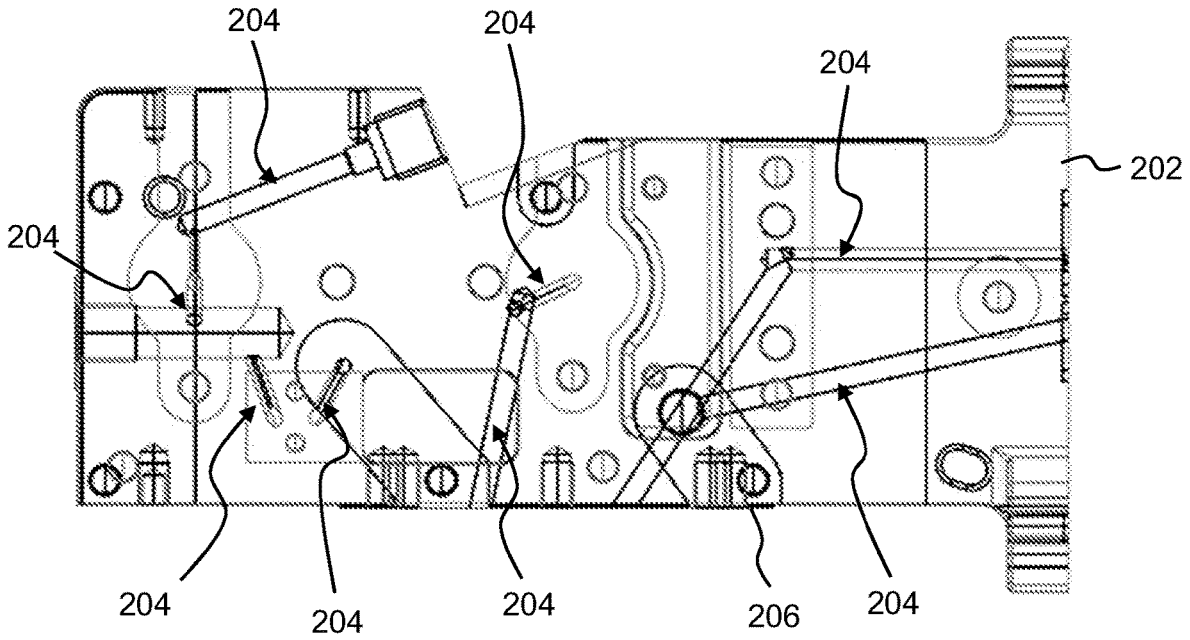
FIG. 3 illustrates a translucent perspective view of a main manifold of the measurement assembly of FIG. 1.
Figure 4:
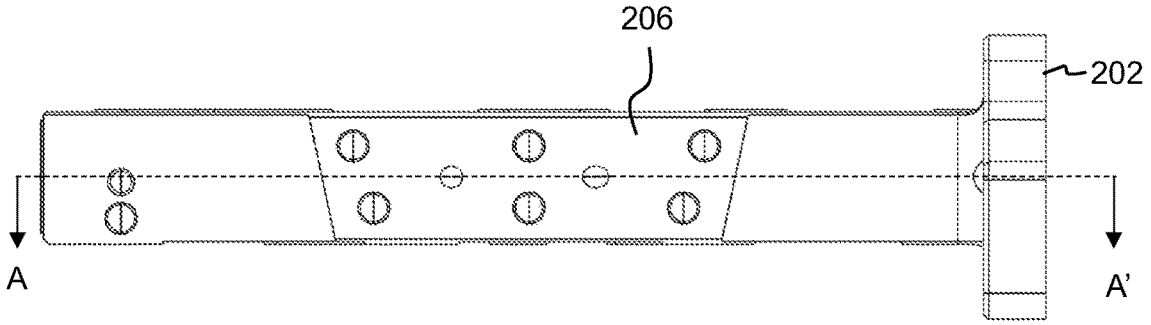
FIG. 4 illustrates a side view of a second surface of the main manifold of FIG. 3.
Figure 5:
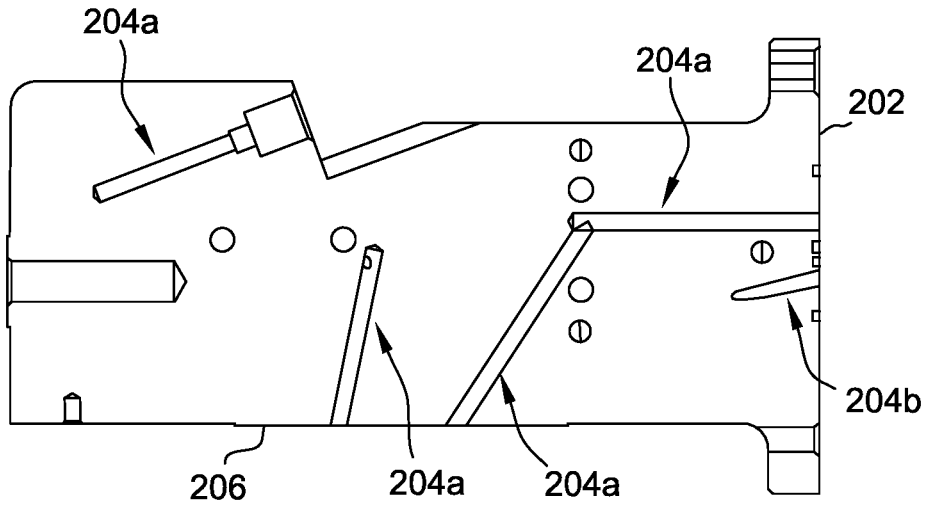
FIG. 5 illustrates a cross-sectional view of the main manifold of FIG. 3 taken along line A-A' of FIG. 4.
Figure 6:
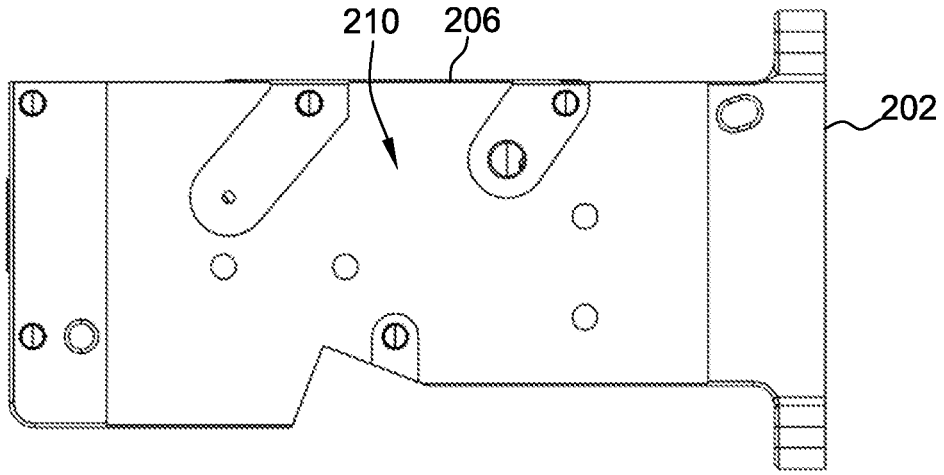
FIG. 6 illustrates a side view of a third surface of the main manifold of FIG. 3.

FIG. 1 is a schematic diagram of an exemplary measurement assembly 100 which includes a flame arrester module 110, a pinole holder module 150, a measurement instrument module 160, and a redundant pump manifold assembly 300 connected to the main manifold 200. FIG. 2 illustrates a perspective view of the main manifold 200. FIG. 3 illustrates a translucent view of the main manifold 200. FIG. 4 illustrates a side view of a second surface 206 of the main manifold 200. FIG. 5 illustrates a cross-sectional view of the main manifold 200 taken along line A-A' of FIG. 4. FIG. 6 illustrates a side view of a third surface 208 of the main manifold 200.

The flame arrester module 110, pinole holder module 150, measurement instrument module 160, and redundant pump manifold assembly 300 are modularly connected to the main manifold 200 (and are hereinafter referred to as "modular components"). A surface of each of the modular components directly contacts outside surfaces of the main manifold 200 such that corresponding inlets and outlets of the modular components align with inlets and outlets of each of the outside surfaces of the main manifold 200. In the illustrated embodiments, the flame arrester module 110 (of FIG. 1) is connected to a first surface 202 of the main manifold 200, the pinole holder module 150 is connected to a second surface 206 of the main manifold 200, the measurement instrument module 160 is connected to a third surface 208 of the main manifold 200 and the redundant pump manifold assembly 300 is connected to a fourth surface 210 of the main manifold 200. The modules are connected to respective surfaces by seating a connection portion of the module to the outside surface. The modules can then be fastened to, or otherwise secured by connecting means the main manifold 200. However, in other embodiments, the modular components can be configured to connect to any of the outside surfaces of the main manifold 200. In some embodiments, gaskets are placed between the surfaces of the main manifold 202, 206, 208, 210 and the respective modular components 110, 150, 160, 300.

Internal conduits 204 of the main manifold 200 are machined or bored into the main manifold 200 from outside surfaces of the main manifold 200. Each of the internal conduits 204 connect the modular components to one another without the use of fittings, pipes or hoses, thereby reducing system complexity and reducing the risk of leak between fittings, pipes, hoses and other modular components. The internal conduits 204 are schematically illustrated in FIG. 1, and are also shown translucently in FIG. 3. FIG. 5 illustrates some of the internal conduits 204*a* which is provided at a right angle relative to the outside surfaces of the main manifold 200, while other internal conduits 204*b* are provided at an acute angle relative to the outside surfaces of the main manifold 200.

The flame arrester module 110 is configured as a primary inlet and outlet for the measurement assembly 100 and in use protects the measurement assembly 100 from ignition of gaseous mixtures within the measurement assembly 100. The flame arrester module 110 includes an inlet 112 and an outlet 114. The inlet 112 and outlet 114 are connected to one or more flame arresters (118, 119) which prevent ignition of gaseous mixtures within the measurement assembly 100. In some embodiments, the input pressure of the fuel gas at the inlet 112 is within the range of 5 psi to 7 psi. In some embodiments, the output pressure of the fuel gas at the output 114 is at atmosphere (approximately 14.7 psi). In some embodiments, a plurality of flame arresters 119 are connected in parallel (indicated as parallel conduits 122) at arrester output 114. In some embodiments, three frame arresters 119 are connected in parallel at the outlet. 114. In some embodiments, an interface block 130 is positioned between the flame arrester module 110 and the main manifold 200.

Referring to FIG. 1, the pinole holder module 150 includes a filter 152 and a pinhole regulator 154. The pinhole regulator 154 receives a gaseous mixture from the inlet of the flame arrester module 110. The pinhole regulator 154 is configured to drop the pressure of the system from the inlet 112 of the flame arrester module 110. In some embodiments, the pinhole regulator 154 is a 100-micron pinhole. A smaller pinhole size of the pinhole regulator 154 can further decrease the pressure of the system as the gaseous mixture passes through the pinhole regulator 154. In some embodiments, the filter is a 2-micron filter. The measurement instrument module 160 receives the gaseous mixture from the pinole holder module 150 and includes a laser spectroscopy instrument 162. In some embodiments, the laser spectroscopy instrument 162 is an ICOS laser spectroscopy system. In some embodiments, the measurement instrument module 160 includes a 1-micron filter 164.

The main manifold 200 further includes a pressure sensor 212, a temperature sensor 214 and a variable pressure valve 216. In some embodiments, one or more of the pressure sensor 212, temperature sensor 214 and variable pressure valve 216 are internal to the main manifold 200. In some embodiments, one or more of the pressure sensor 212, temperature sensor 214 and variable pressure valve 216 are disposed within the thickness of the main manifold 200. In some embodiments, one or more of the pressure sensor 212, temperature sensor 214 and variable pressure valve 216 are modules external to the main manifold and are directly contacted to outside surfaces of the main module 200. The pressure sensor 212, temperature sensor 214 and variable pressure valve 216 receive the gaseous mixture from the measurement instrument module 160. The variable pressure valve 216 is configured to maintain and regulate the system pressure at a specific value. Thus, where fluctuations in pressure may occur due to a pump failure or a momentarily reduced pressure at the inlet 112, the variable pressure valve 216 will maintain the system pressure at the required level. As explained in further detail below, the redundant pump manifold assembly 300 is configured to periodically alternate operability between one or more pumps. During the operability transition between one or more pumps, the variable pressure valve 216 will maintain the system pressure at the required pressure level.

The redundant pump manifold assembly 300 includes a plurality of pumps (311, 312, 313) connected in parallel. The plurality of pumps (311, 312, 313) receive gaseous mixture from the variable pressure valve 216 and expel the gaseous mixture to the outlet 114 of the flame arrester module 110. In some embodiments, the redundant pump manifold assembly 300 further includes a 1-micron filter 302. Only one of the plurality of pumps (311, 312, 313) operate at a given time. In some embodiments, the redundant pump manifold assembly 300 includes three pumps (311, 312, 313). In some embodiments, the redundant pump manifold assembly 300 includes two pumps. In some embodiments, the redundant pump manifold assembly 300 includes four or more pumps.

Figure 7:
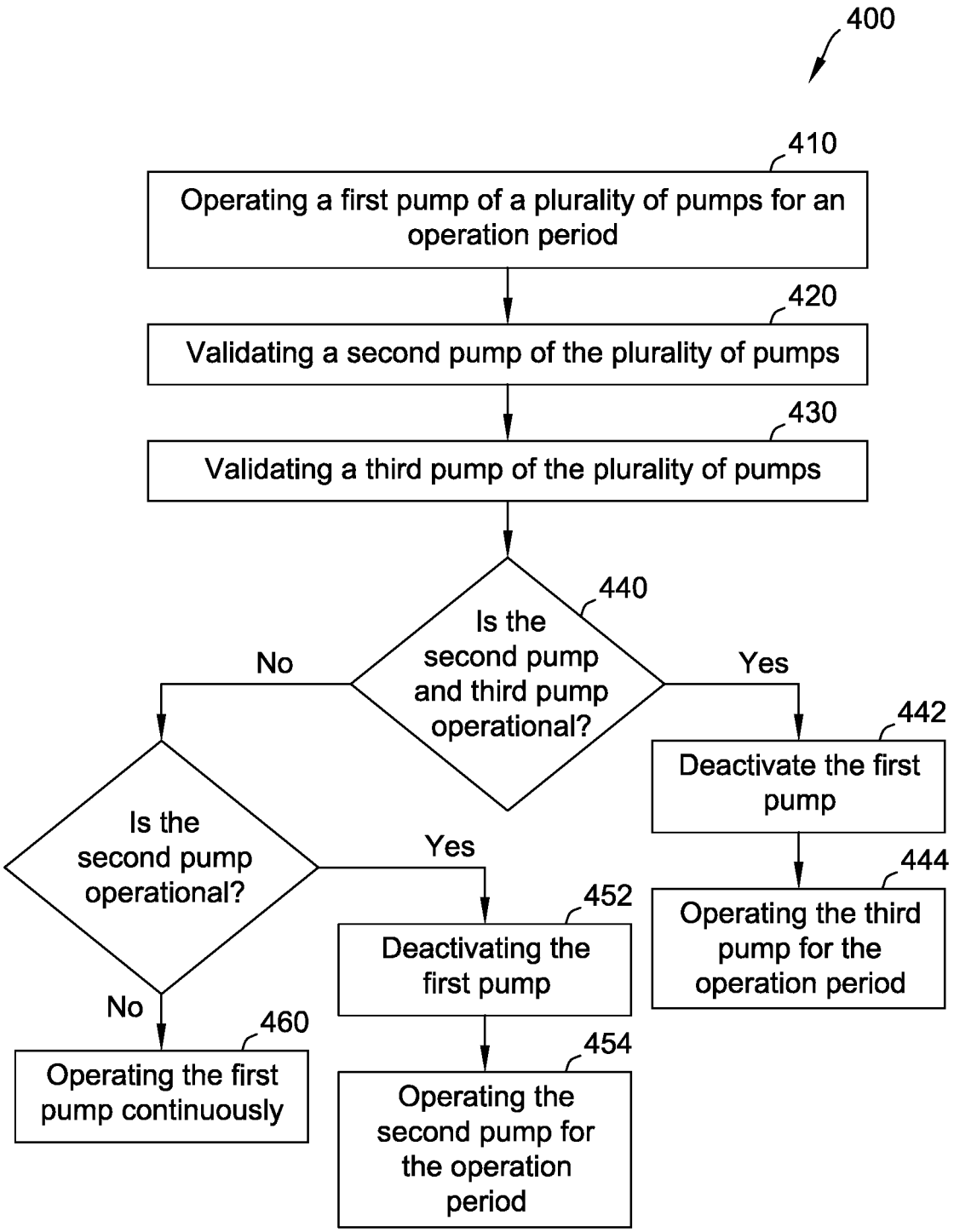
FIG. 7 illustrates a method of operating a redundant pump manifold assembly of the measurement assembly of FIG. 1.

A method 400 of operating the redundant pump manifold assembly 300 is illustrated in FIG. 7. As used herein, the term "operation period" refers to a pre-determined period of time. The operation period can be for a number of days, weeks, or months. In some embodiments, the operation period is one month. In some embodiments, the operation period is two weeks. The method 400 can be performed by a processor 502 (as shown in FIG. 1) communicatively connected to each of the plurality of pumps (311, 312, 313), the processor configured to send instructions to each of the plurality of pumps (311, 312, 313), and the instructions can be stored in memory 504. In some embodiments, the processor 502 and memory 504 are integrated to the redundant pump manifold assembly 300. In some embodiments, the processor 502 and memory 504 are external to the redundant pump manifold assembly 300.

The method 400 includes operating 410 a first pump 311 of the plurality of pumps for the operation period. After the end of the operation period of the first pump 311, the method 400 further includes validating 420 a second pump 312 of the plurality of pumps and, validating 430 a third pump 313 of the plurality of pumps. As used herein, the term "validating" shall mean performing a system check to determine if a pump of the plurality of pumps (311, 312, 313) is operational. In some embodiments, validating can include temporarily operating a pump of the plurality of pumps (311, 312, 313) for a validation time. In some embodiments, validating can include passing voltage through a pump of the plurality of pumps (311, 312, 313). In some embodiments, each pump the plurality of pumps (311, 312, 313) include a built-in validation feature known in the art. In some embodiments, the validation time is in the range of 1 second to 10 seconds. In some embodiments, system will wait for 10 seconds before evaluating if a pump of the plurality of pumps (311, 312, 313) is operating correctly. In some embodiments, to evaluate if a pump is operational, the system will determine if pressure in the cell is bellow a defined threshold. The system can further check by determining if a pump can maintain the pressure in the cell below a certain pressure (such as 202 hPa) for the validation time after the pump switch.

If the second pump 312 and the third pump 313 are operational, the method 400 further includes deactivating 442 the first pump 311 and operating 444 the third pump 313 for the operation period. The method steps 442 and 444 can be performed by the processor 502 as an if-then logic function 440 (illustrated in FIG. 7).

If the second pump 312 is operational, but the third pump 313 is not operational, the method further includes deactivating 452 the first pump 311 and operating 454 the second pump 312 for the operation period. The method steps 452 and 454 can be performed by the processor 502 as an if-then logic function 450 (illustrated in FIG. 7).

If the second pump 312 is not operational and the third pump 313 is not operational, the method 400 further includes operating 460 the first pump 313 continuously. In some embodiments, if one or all of the plurality of pumps (311, 312, 313) are not operational or otherwise defective, the processor 502 can send a warning to a user interface 506 (as shown in FIG. 1). Thus, plurality of pumps (311, 312, 313) are not operational or otherwise defective, the method 400 further includes the step of sending a warning to the user interface 506.

The method 400 can be repeated. By way of example, after the third pump 313 has operated for the operation period, the method can further include validating the first pump 311, validating the second pump 312 and operating the second pump 312 for the operation period. After the second pump 312 has operated for the operation period, the method can further include validating the third pump 313, validating the first pump 311 and operating the first pump 311 for the operation period. Where one of the plurality of pumps (311, 312, 313) are not operational or are otherwise defective, the method 400 can perform continuous operation periods and validations for the remaining validated pumps. In some embodiments, the order of operation of the first, second and third does not reflect the only order of operation. The plurality of pumps (311, 312, 313) can be activated and shut down in any order and although the pumps are described as being shut down and activated singly, any number of pumps can be activated and shut down to maximize pump operability and minimize analysis cell down time.

Figure 8:
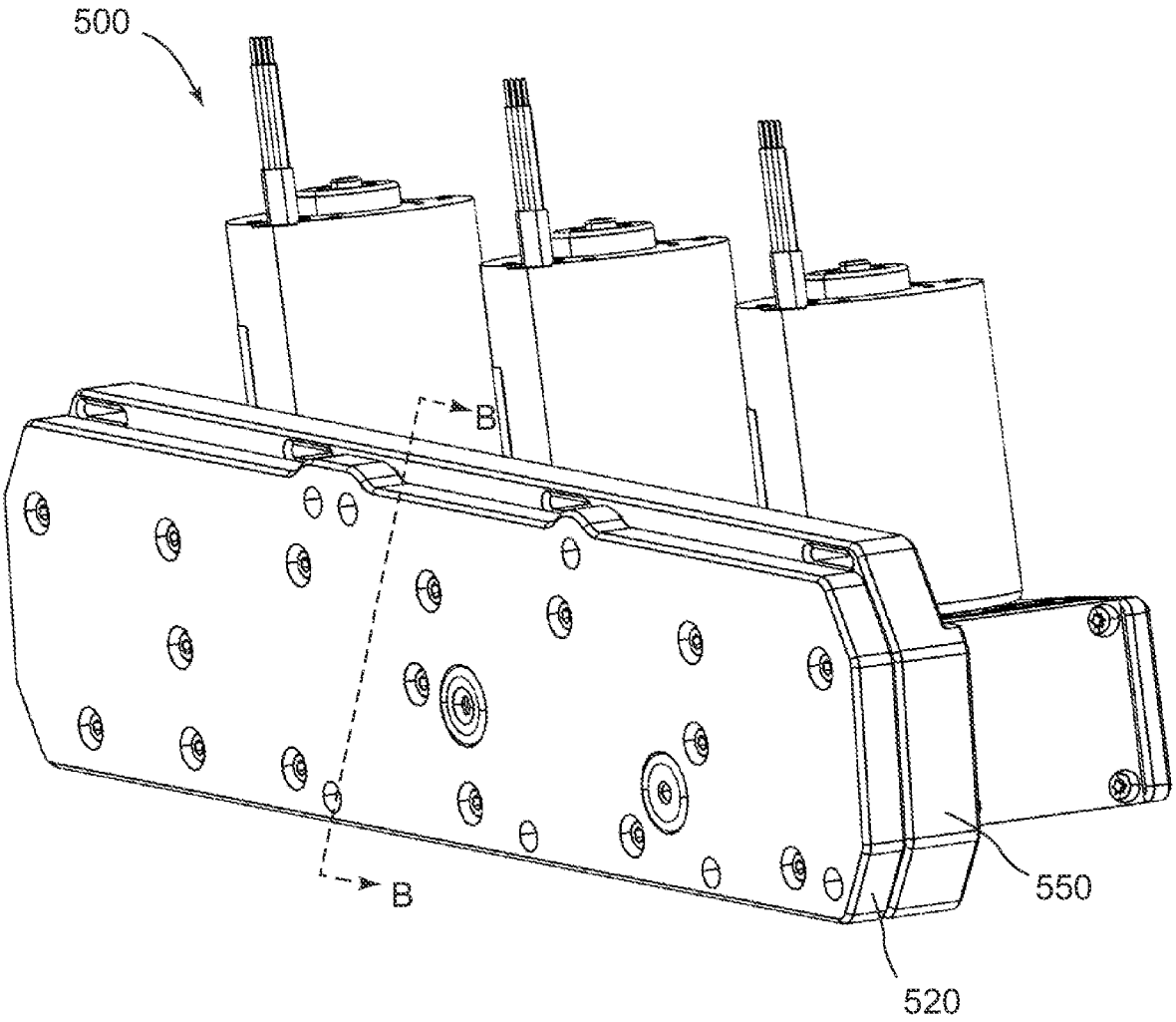
FIG. 8 illustrates a perspective view of a redundant pump manifold assembly in accordance with one or more embodiments of the present disclosure.
Figure 9:
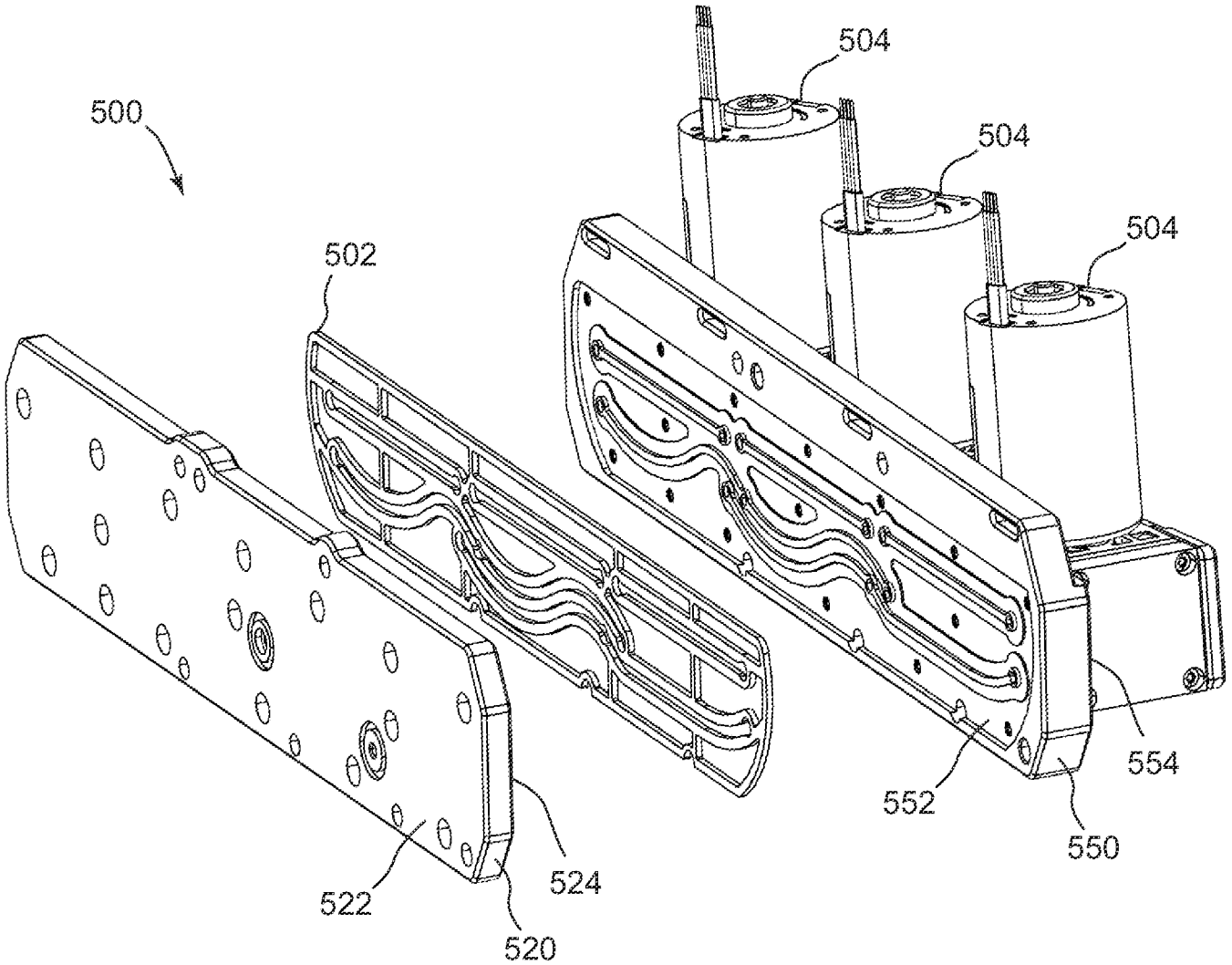
FIG. 9 illustrates an exploded view of the redundant pump manifold assembly of FIG. 8.
Figure 10:
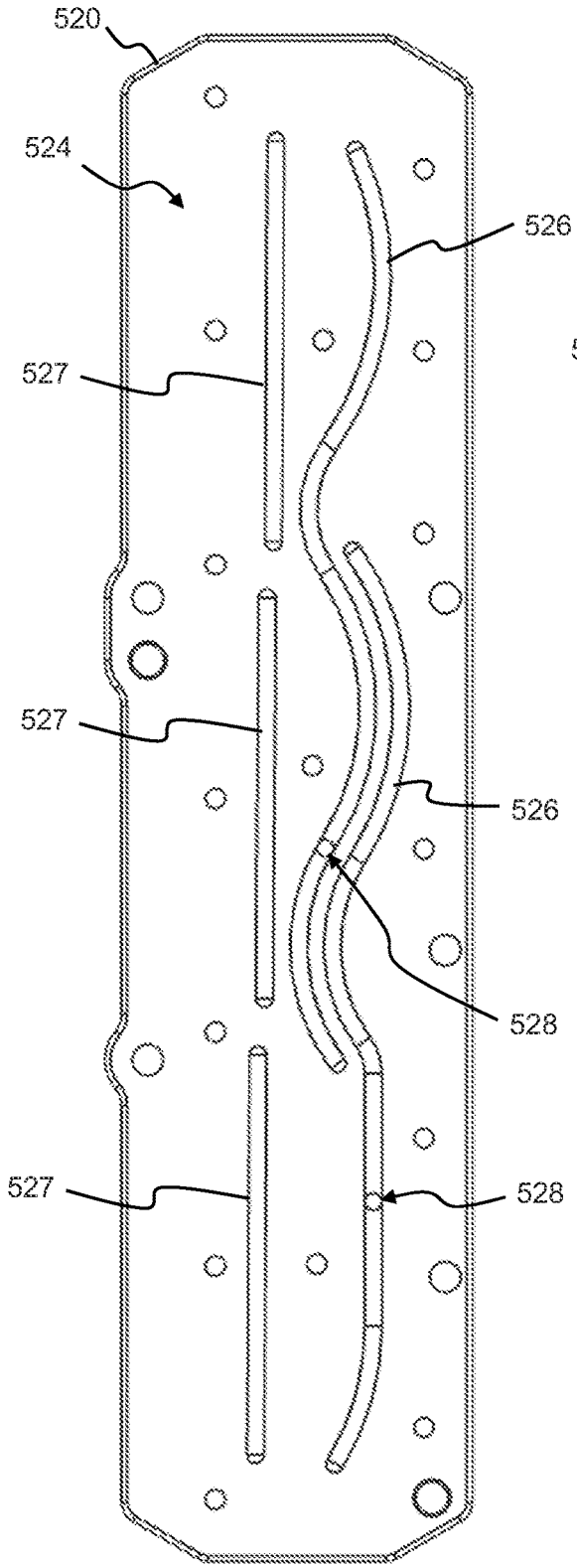
FIG. 10 illustrates a side view of a first plate of the redundant pump manifold assembly of FIG. 8.
Figure 11:
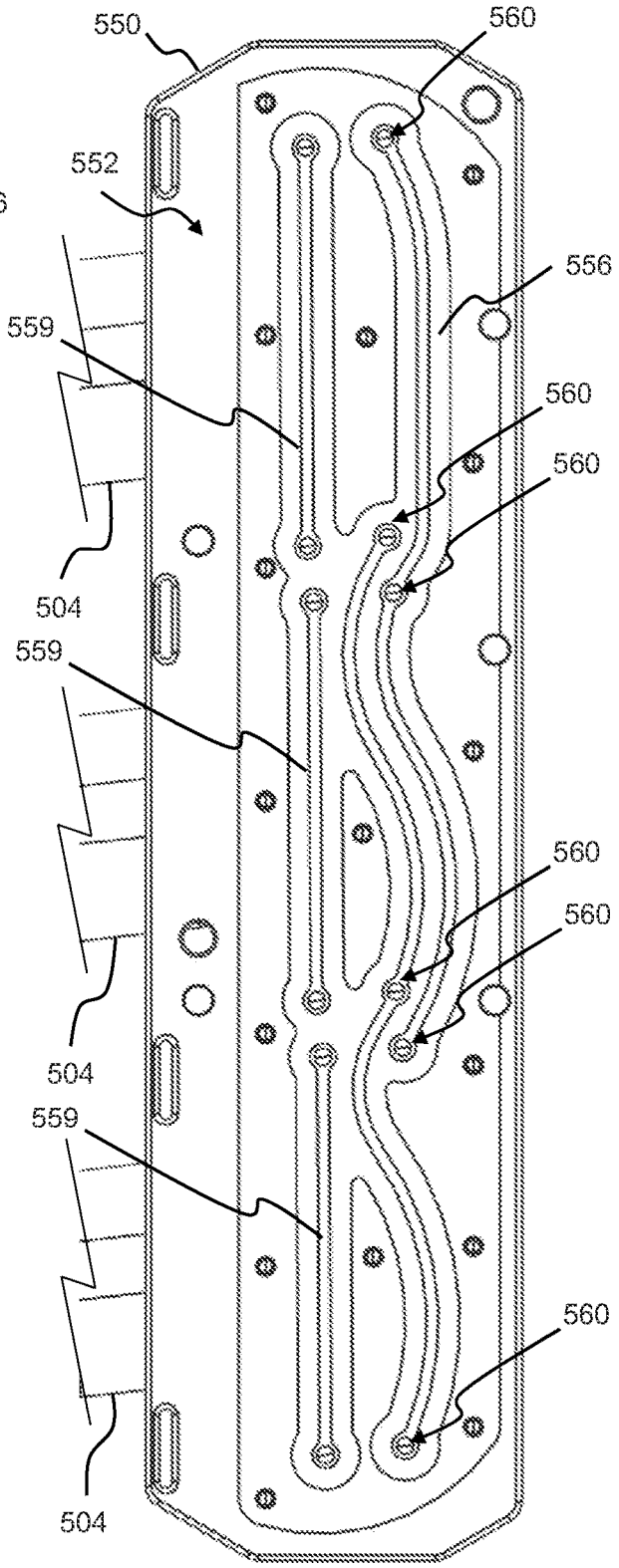
FIG. 11 illustrates a side view of a second plate of the redundant pump manifold assembly of FIG. 8; and, FIG. 12 illustrates a cross-sectional view of the redundant pump manifold assembly of FIG. 8 taken along line B-B of FIG. 8.
Figure 12:
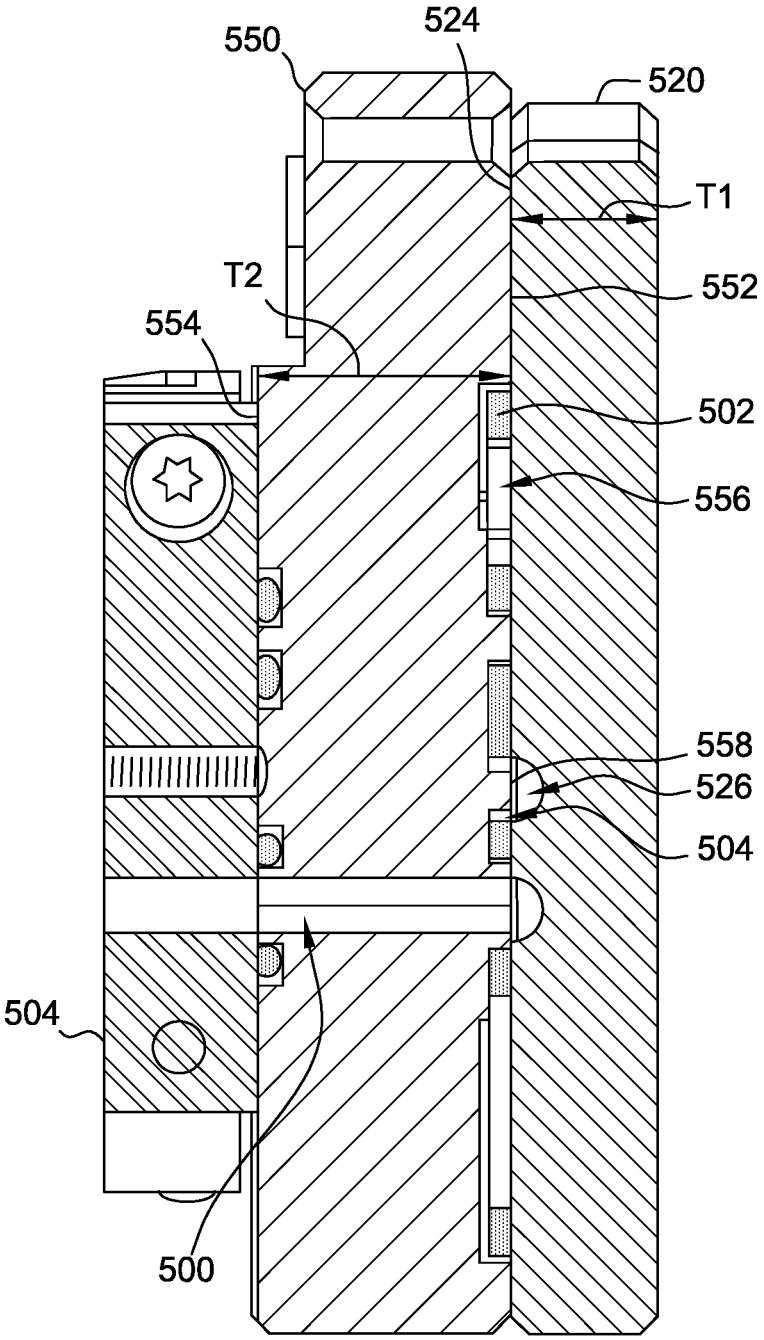

FIG. 8 illustrates a perspective view of a redundant pump manifold assembly 500 in accordance with one or more embodiments of the present disclosure. FIG. 9 illustrates an exploded view of the redundant pump manifold assembly 500 of FIG. 8. FIG. 10 illustrates a side view of a first plate 520 of the redundant pump manifold assembly 500 of FIG. 8. FIG. 11 illustrates a side view of a second plate 550 of the redundant pump manifold assembly 500 of FIG. 8. FIG. 12 illustrates a cross-sectional view of the redundant pump manifold assembly 500 of FIG. 8 taken along line B-B of FIG. 8.

The first plate 520 includes a first surface 522 and a second surface 524. The first surface 522 and the second surface 524 of the first plate 520 define a thickness T1 of the first plate 520. The second plate 550 includes a first surface 552 and a second surface 554. The first surface 552 and the second surface 554 of the second plate 550 define a thickness T2 of the second plate 550.

The first surface 522 of the first plate 520 is connected and abuts the fourth surface 210 of the main manifold 200 (of FIG. 6). The second surface 524 of the first plate 520 is connected to and abuts the first surface 552 of the second plate 520. As shown in FIGS. 9 and 12, a gasket 502 is positioned between the second surface 524 of the first plate 520 and the first surface 552 of the second plate 520, creating a seal.

As best shown in FIGS. 10 and 12, a plurality of channels 526 are formed in the second surface 524 of the first plate 520. The plurality of channels 526 are fluidly connected to the internal conduits 204 of the main manifold by apertures 528 extending through the thickness T1 of the first plate 520 and connecting to the internal conduits 204. Each of the plurality of channels 526 connect a plurality of pumps 504

As best shown in FIGS. 11 and 12, the first surface 552 of the second plate 550 includes a recessed surface 556 into which the gasket 502 is seated. The recessed surface 556 is configured to seat the gasket 502 such that when the first plate 520 is positioned against the second plate 550, a fluid seal is created. Where the second surface 524 of the first plate 520 includes plurality of channels 526, the first surface 552 of the second plate 550 includes corresponding protrusions 558 extending from the recessed surface 556. In some embodiments, the corresponding protrusions 558 extend beyond the first surface 552 of the second plate 550. In some embodiments, the corresponding protrusions 558 extend to the first surface 552 of the second plate 550.

As shown in FIG. 12, each channel 526 of the first plate 520 is aligned with the corresponding protrusion 558 of the second plate 550 when the first plate 520 and second plate 550 are connected. The corresponding protrusion 558 has a width smaller than a width of the channel 526 such that the gasket 502 can expand into a gap 504 between the corresponding protrusion 558 of the second plate 550 and the gasket 502. The gap 504 allows for both lateral and medial expansion of the gasket 502 such that the gasket 502 creates a proper fluid seal and the gasket 502 does not expand into the channel 526, blocking flow of the gaseous mixture.

As shown in FIGS. 11 and 12, the corresponding protrusions 558 of the second plate 550 include apertures 560 extending into the thickness T2 of the second plate 550 and into corresponding inlets and outlets of the pumps 504. The channel 526 and corresponding protrusions 558 are configured to connect the pumps 504 in parallel. In some embodiments where the pumps are double head pumps, a second set of channel 527 and corresponding protrusions 559 are configured to connect pumps to adjacent pumps in series.

The systems and methods are not limited to the specific embodiments described herein but, rather, components of the systems and/or operations of the methods may be utilized independently and separately from other components and/or operations described herein. Further, the described components and/or operations may also be defined in, or used in combination with, other systems, methods, and/or devices, and are not limited to practice with only the systems described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for operating a redundant pump assembly comprising at least three pumps connected in parallel, the redundant pump assembly having a manifold configured to connect the at least three pumps in parallel, the manifold comprising:

a first plate having a first surface and a second surface defining a thickness of the first plate, the second surface including a plurality of channels extending into the second surface, and a first aperture and second aperture extending from the plurality of channels to the first surface; and, a second plate having a first surface and a second surface defining a thickness of the second plate, the first surface of the second plate abutting the second surface of the first plate, wherein:

corresponding protrusions extend from a recessed surface of the second plate, the corresponding protrusions configured to align with the plurality of channels, and the plurality of channels are configured to connect the at least three pumps in parallel via apertures extending through the corresponding protrusions; and the method comprising:

operating a first pump of the at least three pumps to draw a fluid from the manifold for an operation period, wherein the operation period is a pre-determined period of time for which only one of the at least three pumps operates prior to validating a remainder of the at least three pumps, wherein the remainder of the at least three pumps is a second pump and a third pump, and wherein the remainder of the at least three pumps are inactive for the operation period of the first pump;

at an end of the operation period of the first pump of the at least three pumps, and while the remainder of the at least three pumps are inactive, determining if either of the remainder of the at least three pumps may be switched from the inactive state to an operational state by performing a validation test of each of the remainder of the at least three pumps at the end of the operation period of the first pump, without operating the remainder of the at least three pumps; and if either of the remainder of the at least three pumps are determined to be suitable for the operational state, the method further comprising deactivating the first pump and activating one of the remainder of the at least three pumps such that the one of the remainder of the at least three pumps operates for the operation period to draw the fluid from the manifold while the fluid flows continuously through the manifold.

2. The method of claim 1, further comprising:

if the third pump is activated for the operation period, at the end of the operation period of the third pump of the at least three pumps, and while the remainder of the at least three pumps includes the first pump and the second pump, wherein the remainder of the at least three pumps are inactive, determining either of the remainder of the at least three pumps may be switched from the inactive state to the operational state by performing a validation test of each of the remainder of the at least three pumps at the end of the operation period of the third pump, without operating the remainder of the at least three pumps; and if either of the remainder of the at least three pumps is determined to be suitable for the operational state, the method further comprises deactivating the third pump of the at least three pumps and activating one of the remainder of the at least three pumps such that the one of the remainder of the at least three pumps operates for the operation period.

3. The method of claim 2, further comprising:

if the second pump is activated for the operation period, at the end of the operation period of the second pump, of the at least three pumps, and while the remainder of the at least three pumps includes the first pump and the third pump, wherein the remainder of the at least three pumps are inactive, determining either of the remainder of the at least three pumps may be switched from the inactive state to an operational state by performing a validation test of each of the remainder of the at least three pumps at the end of the operation period of the second pump, without operating the remainder of the at least three pumps; and if either of the remainder of the at least three pumps is determined to be suitable for the operational state, the method further comprises deactivating the second pump and activating one of the remainder of the at least three pumps such that the one of the remainder of the at least three pumps operates for the operation period.

4. The method of claim 1, wherein the operation period of each of the at least three pumps is one month.

5. The method of claim 1, wherein the first pump, the second pump, and the third pump of the at least three pumps are connected in parallel.

6. The method of claim 1, wherein a processor and memory are communicatively coupled to each of the first pump, the second pump, and the third pump of the at least three pumps, wherein the processor is configured to send instructions to each of the first pump, the second pump, and the third pump, and wherein the instructions are stored in memory.

7. The method of claim 6, wherein the processor is configured to:

operate the first pump for the operation period;

determine if the remainder of the at least three pumps may be switched from the inactive state to the operational state at the end of the operation period of the first pump of the at least three pumps; and if either of the remainder of the at least three pumps are determined to be suitable for the operational state, deactivate the first pump and activate one of the remainder of the at least three pumps such that the one of the remainder of the at least three pumps operates for the operation period.

8. The method of claim 1, wherein the steps of determining if a pump of the at least three pumps may be switched from the inactive state to the operational state include one or more of performing a system check to determine if one of the at least three pumps is operational and passing voltage through one pump of the at least three pumps.

9. The method of claim 1, wherein if while determining if either of the remainder of the at least three pumps may be switched from the inactive state to the operational state, the second pump is not determined to be suitable for the operational state and the third pump is not determined to be suitable for the operational state, the method further includes operating the first pump continuously.

10. The method of claim 1, wherein if one or all of the at least three pumps are not operational, the method further includes the step of sending a warning to a user interface.

11. A redundant pump manifold assembly for use with a measurement instrument comprising:

a first plate having a first surface and a second surface defining a thickness of the first plate, the second surface including a plurality of channels extending into the second surface, and a first aperture and second aperture extending from the plurality of channels to the first surface; and, a second plate having a first surface and a second surface defining a thickness of the second plate, the first surface of the second plate abutting the second surface of the first plate, wherein:

the first surface of the second plate includes a recessed surface configured to receive a gasket positioned between the first plate and second plate creating a fluid seal between the first plate and second plate, corresponding protrusions extend from the recessed surface of the second plate, the corresponding protrusions configured to align with the plurality of channels, and the plurality of channels are configured to connect at least three pumps in parallel via apertures extending through the corresponding protrusions.

12. The assembly of claim 11, wherein the corresponding protrusions extend to the first surface of the second plate.

13. The assembly of claim 11, wherein the corresponding protrusions have a width smaller than a width of the plurality of channels such that the gasket can expand into a gap between the corresponding protrusion of the second plate and the gasket, wherein the gap allows for both lateral and medial expansion of the gasket and the gasket does not expand into the plurality of channels.

14. The assembly of claim 11, wherein the first surface of the first plate abuts a main manifold of the measurement instrument, the main manifold including an inlet aperture and an outlet aperture, the inlet aperture and outlet aperture aligned with the first aperture and second aperture of the plurality of channels of the first plate such that the inlet aperture and outlet aperture are in fluid communication with the first aperture and second aperture, wherein the first surface of the first plate and the main manifold create a seal.

15. The assembly of claim 11 further comprising a plurality of pumps in contact with the second surface of the second plate, wherein each of the pumps have an inlet and an outlet, the inlet and outlet of each of the pumps in fluid communication with apertures extending through the thickness of the second plate, the apertures of the second plate aligning with the plurality of channels of the first plate.

16. A method for operating a redundant pump assembly comprising at least three pumps connected in parallel, the redundant pump assembly having a manifold configured to connect the at least three pumps in parallel, the manifold comprising:

a first plate having a first surface and a second surface defining a thickness of the first plate, the second surface including a plurality of channels extending into the second surface, and a first aperture and second aperture extending from the plurality of channels to the first surface; and, a second plate having a first surface and a second surface defining a thickness of the second plate, the first surface of the second plate abutting the second surface of the first plate, wherein:

the first surface of the second plate includes a recessed surface for receiving a gasket positioned between the first plate and second plate creating a fluid seal between the first plate and second plate, corresponding protrusions extend from the recessed surface of the second plate, the corresponding protrusions configured to align with the plurality of channels, and the plurality of channels are configured to connect the at least three pumps in parallel via apertures extending through the corresponding protrusions; and the method comprising:

operating a first pump of the at least three pumps to draw a fluid from the manifold for an operation period, wherein the operation period is a pre-determined period of time for which only one of the at least three pumps operates prior to validating a remainder of the at least three pumps, wherein the remainder of the at least three pumps is a second pump and a third pump, and wherein the remainder of the at least three pumps are inactive for the operation period of the first pump;

at an end of the operation period of the first pump of the at least three pumps, and while the remainder of the at least three pumps are inactive, determining if either of the remainder of the at least three pumps may be switched from the inactive state to an operational state by performing a validation test of each of the remainder of the at least three pumps at the end of the operation period of the first pump, without operating the remainder of the at least three pumps; and if either of the remainder of the at least three pumps are determined to be suitable for the operational state, the method further comprising deactivating the first pump and activating one of the remainder of the at least three pumps such that the one of the remainder of the at least three pumps operates for the operation period to draw the fluid from the manifold while the fluid flows continuously through the manifold.

17. The method of claim 16, further comprising:

if the third pump is activated for the operation period, at the end of the operation period of the third pump of the at least three pumps, and while the remainder of the at least three pumps includes the first pump and the second pump, wherein the remainder of the at least three pumps are inactive, determining either of the remainder of the at least three pumps may be switched from the inactive state to the operational state by performing a validation test of each of the remainder of the at least three pumps at the end of the operation period of the third pump, without operating the remainder of the at least three pumps; and if either of the remainder of the at least three pumps is determined to be suitable for the operational state, the method further comprises deactivating the third pump of the at least three pumps and activating one of the remainder of the at least three pumps such that the one of the remainder of the at least three pumps operates for the operation period.

18. The method of claim 16, further comprising:

if the second pump is activated for the operation period, at the end of the operation period of the second pump, of the at least three pumps, and while the remainder of the at least three pumps includes the first pump and the third pump, wherein the remainder of the at least three pumps are inactive, determining either of the remainder of the at least three pumps may be switched from the inactive state to an operational state by performing a validation test of each of the remainder of the at least three pumps at the end of the operation period of the second pump, without operating the remainder of the at least three pumps; and if either of the remainder of the at least three pumps is determined to be suitable for the operational state, the method further comprises deactivating the second pump and activating one of the remainder of the at least three pumps such that the one of the remainder of the at least three pumps operates for the operation period.

19. The method of claim 16, wherein a processor and memory are communicatively coupled to each of the first pump, the second pump, and the third pump of the at least three pumps, wherein the processor is configured to send instructions to each of the first pump, the second pump, and the third pump, and wherein the instructions are stored in memory.

20. The method of claim 19, wherein the processor is configured to:

operate the first pump for the operation period;

determine if the remainder of the at least three pumps may be switched from the inactive state to the operational state at the end of the operation period of the first pump of the at least three pumps; and if either of the remainder of the at least three pumps are determined to be suitable for the operational state, deactivate the first pump and activate one of the remainder of the at least three pumps such that the one of the remainder of the at least three pumps operates for the operation period.

* * * * *